US009183692B2

(12) United States Patent
Smith et al.

(10) Patent No.: US 9,183,692 B2
(45) Date of Patent: Nov. 10, 2015

(54) SECURE STORAGE APPARATUS

(71) Applicant: FKI Security Products, New Albany, IN (US)

(72) Inventors: Michael J. Smith, Scottsburg, IN (US); David Murch, Chicago, IL (US); John Rhoads, Argyle, TX (US); Matt Marquardt, Santee, CA (US)

(73) Assignee: Fire King Security Products, LLC, New Albany, IN (US)

( * ) Notice: Subject to any disclaimer, the term of this patent is extended or adjusted under 35 U.S.C. 154(b) by 116 days.

(21) Appl. No.: 14/046,764

(22) Filed: Oct. 4, 2013

(65) Prior Publication Data

US 2015/0096865 A1 Apr. 9, 2015

(51) Int. Cl.

| | |
|---|---|
| ***G07F 7/00*** | (2006.01) |
| ***G07D 11/00*** | (2006.01) |
| ***G07F 19/00*** | (2006.01) |

(52) U.S. Cl.

CPC ..... *G07D 11/0093* (2013.01); *G07D 11/009* (2013.01); *G07F 19/00* (2013.01)

(58) Field of Classification Search

CPC ..... G07F 7/04; G07F 19/20; G07F 19/201; G07F 9/026; G07F 17/0092; G07F 11/002; G07D 11/0081; G07D 11/0084; G07D 7/00; G07D 7/12; G07D 7/20; G07D 11/0018; B65H 2701/1912; G06Q 20/042; G06Q 40/00; G06Q 10/087; G06Q 20/1085; G06F 19/3462; G06F 9/4446; G06F 3/0481; G06F 3/04895; G06F 9/4443; G06F 3/0489; G06F 3/011; G06F 3/04855; G06F 11/2257; G06F 3/04812; G06F 3/0482; G06F 17/30873; G01C 21/36; G09B 19/0053; G05B 2219/23258

USPC ..... 358/1.2; 715/705–715, 762, 763, 973; 194/206, 207; 209/534; 235/379; 700/236

See application file for complete search history.

(56) References Cited

U.S. PATENT DOCUMENTS

| | | | | |
|---|---|---|---|---|
| 5,918,720 | A | 7/1999 | Robinson | |
| 7,063,252 | B2 | 6/2006 | Smith | |
| 7,576,633 | B2 * | 8/2009 | McGunn et al. | 340/5.73 |
| 2005/0144996 | A1 * | 7/2005 | McGunn et al. | 70/278.7 |
| 2005/0183059 | A1 * | 8/2005 | Loksh et al. | 717/101 |
| 2006/0237282 | A1 * | 10/2006 | Walker et al. | 194/217 |
| 2008/0013112 | A1 * | 1/2008 | Yokoyama et al. | 358/1.2 |
| 2008/0237371 | A1 * | 10/2008 | Hornsby et al. | 239/375 |
| 2012/0073482 | A1 * | 3/2012 | Meeker et al. | 109/23 |
| 2013/0151962 | A1 * | 6/2013 | Chen et al. | 715/705 |
| 2013/0161153 | A1 * | 6/2013 | Saez et al. | 194/215 |
| 2013/0183075 | A1 * | 7/2013 | Kim et al. | 400/619 |

* cited by examiner

*Primary Examiner* — Jeffrey Shapiro

(74) *Attorney, Agent, or Firm* — Great Lakes Intellectual Property, PLLC

(57) ABSTRACT

Assisting users with controlling, navigating and performing any number of other operations for a secure storage apparatus is contemplated. The assistance may be in the form of easily navigable instructions/menus/screen and/or printed instructions, which may be optionally tailored to the particular operation contemplated for performance.

18 Claims, 6 Drawing Sheets

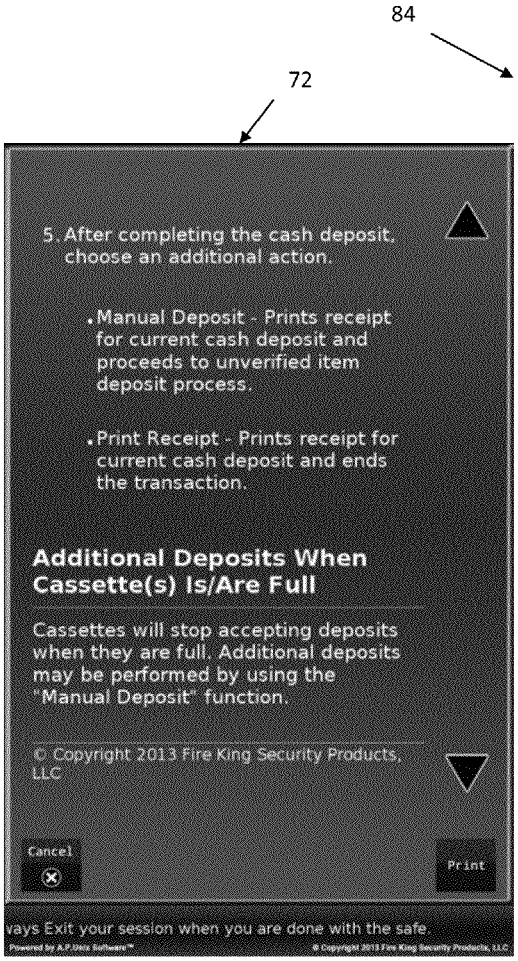

Fig. 7

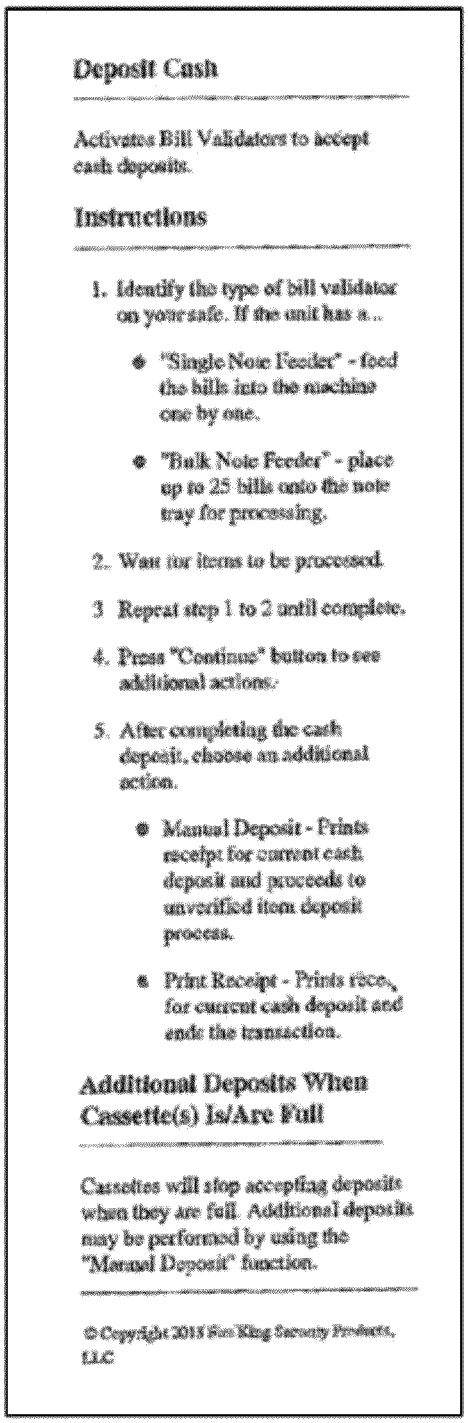

Deposit Cash

Activates Bill Validators to accept cash deposits.

Instructions

1. Identify the type of bill validator on your safe. If the unit has a...
   - "Single Note Feeder" - feed the bills into the machine one by one.
   - "Bulk Note Feeder" - place up to 25 bills onto the note tray for processing.
2. Wait for items to be processed.
3. Repeat step 1 to 2 until complete.
4. Press "Continue" button to see additional actions.
5. After completing the cash deposit, choose an additional action.
   - Manual Deposit - Prints receipt for current cash deposit and proceeds to unverified item deposit process.
   - Print Receipt - Prints rece, for current cash deposit and ends the transaction.

Additional Deposits When Cassette(s) Is/Are Full

Cassettes will stop accepting deposits when they are full. Additional deposits may be performed by using the "Manual Deposit" function.

© Copyright 2013 Fire King Security Products, LLC

Fig. 8

SECURE STORAGE APPARATUS

TECHNICAL FIELD

The present invention relates to secure storage apparatuses, such as but not necessarily limited to safes, vending machines and video gaming machines.

BACKGROUND

Safes, vending machines, video gaming units and other devices may receive bank notes, coins, paper money or other valuables for safekeeping. More and more of theses secure storage apparatuses are being manufactured with various electronically controllable operations. U.S. Pat. Nos. 5,918,720 and 7,063,252 and U.S. patent application Ser. Nos. 13/248,000 and 13/752,686, the disclosures of which are hereby incorporated by reference in their entireties, describe safes having such electronically controllable operations, amongst others. Users of such devices may experience difficulties in performing, controlling or otherwise manipulating the electronically controllable operations. Accordingly, one non-limiting aspect of the present invention contemplates providing such users with help instructions and/or other information sufficient to provide assistance when attempting to engage the electronically controllable operations.

BRIEF DESCRIPTION OF THE DRAWINGS

FIGS. 6-7 illustrate the GUI scrolling through the help instructions in accordance with one non-limiting aspect the present invention.

FIG. 8 illustrates a help receipt in accordance with non-limiting aspect of the present invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
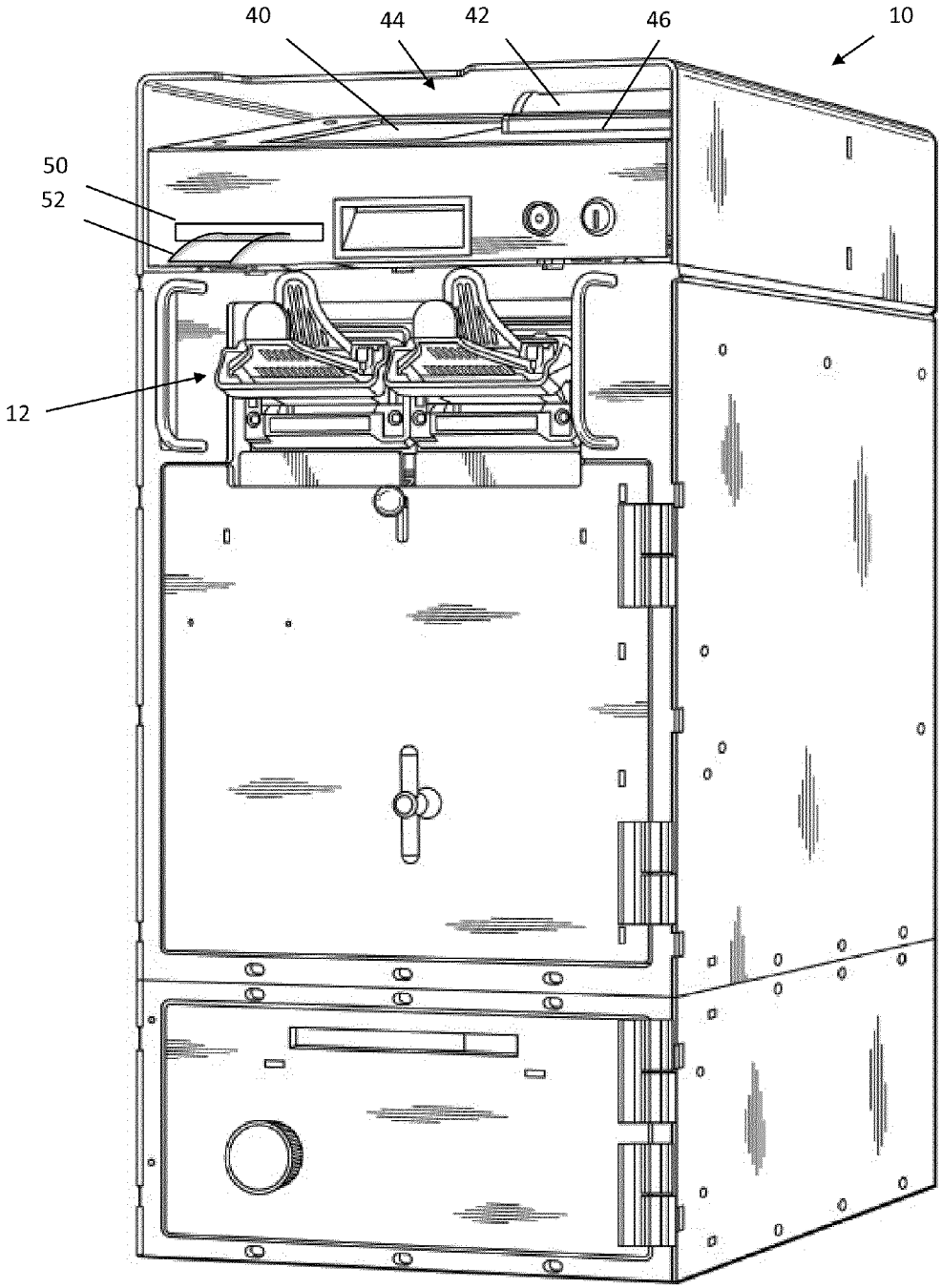
FIG. 1 illustrates a secure storage apparatus in accordance with non-limiting aspect of the present invention.
Figure 2:
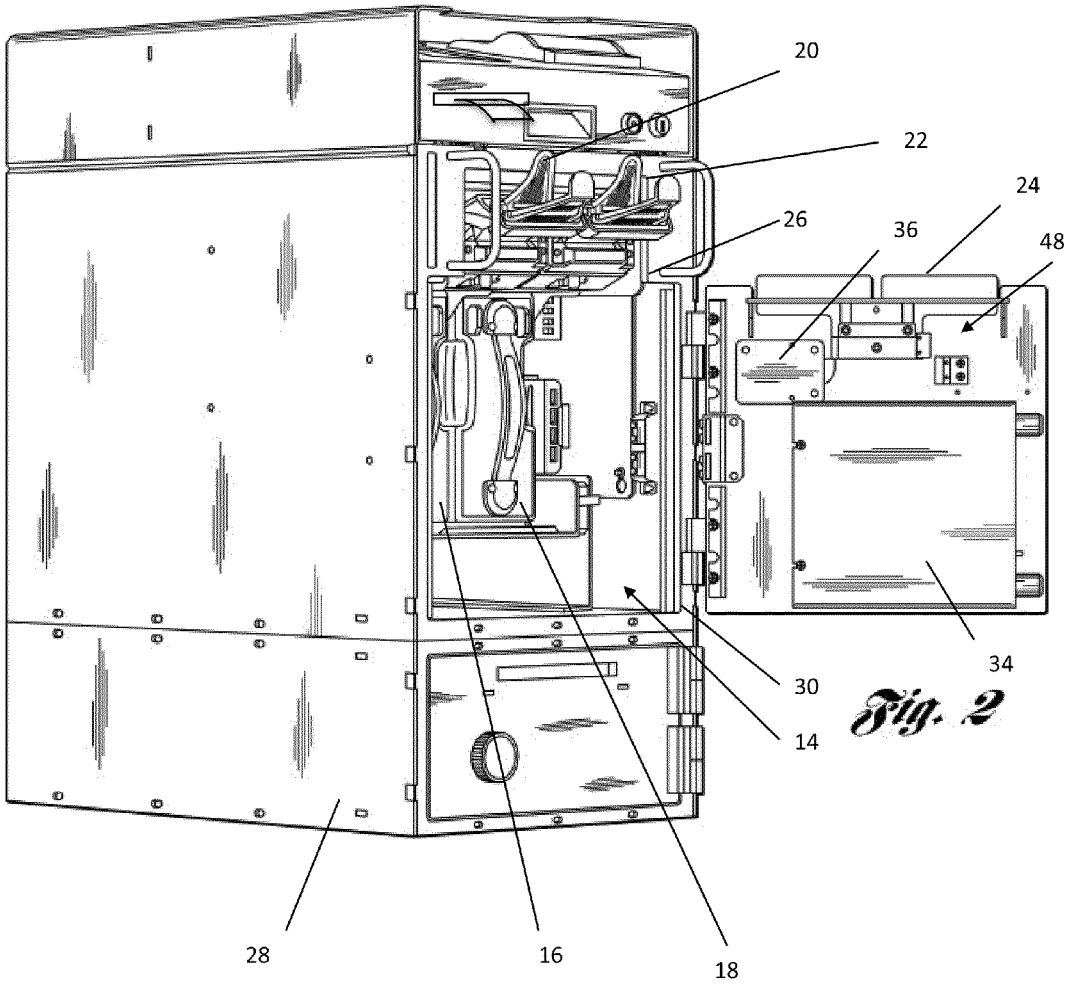
FIG. 2 illustrates an interior storage location of the secure storage apparatus as contemplated by one non-limiting aspect of the present invention.

FIG. 1 illustrates a secure storage apparatus 10 in accordance with non-limiting aspect of the present invention. The secure storage apparatus 10 corresponds with that described in U.S. patent application Ser. No. 13/752,686 and may be configured to facilitate safekeeping of deposits, such as but not necessarily limited to deposits in the form of coins, paper currency, bills, documents, letters, boxes or other items that may be electro-mechanically delivered through an exterior input for safekeeping within an interior storage location. The secure storage apparatus 10 is predominately described with respect to being configured as a safe having a sorter 12 configured as a bill validator operable to receive and process paper currency for safekeeping. FIG. 2 illustrates an interior storage location 14 of the secure storage apparatus 10 as contemplated by one non-limiting aspect of the present invention. The interior storage location 14 is shown to include a first cassette 16 and a second cassette 18 operable with a first head 20 and a second head 22 of the bill validator 12 to facilitate processing and safe storage of paper currency. The secure storage apparatus 10 may be configured to facilitate servicing of the bill validator 12 while maintaining security of the currency kept within the first and second storage cassettes 16, 18.

The apparatus 10 may include a shutter 24 mounted or otherwise affixed to a door 24 to permit servicing of the bill validator 12 while maintaining security of the stored items. The shutter 22 may be movable positionable relative to a first opening 26 in a substantially enclosed housing 28 forming a body of the apparatus 10. The first opening 26 may be sufficiently shaped within a side of the housing 28 to permit removal of the bill validator 12, one or more of the bill validator heads 20, 22 or other component of the validator 12, therethrough. The door 24 may be movable positioned relative to a second opening 30 in the side of the housing 28. The second opening 30 may be shaped to permit removal of the cassettes 16, 18 or other storage container configured to receive the deposit therethrough. The shutter 22 may be movable positioned between a closed position and an opened position to respectively prevent and permit removal of the bill validator. The door may be movable between a closed position (see FIG. 1) and an opened position (see FIG. 2) to respectively prevent and permit removal of the storage cassette 16, 18. The shutter 22 may be configured in accordance with the present invention to permit removal of the bill validator 12 while the door 24 is in the closed position, thereby enabling servicing of the bill validator 12 without compromising security of the deposited items.

A door lock 34 may be included to lock the door 24 to the housing independently of a shutter lock 36. (While shown on the door, the door lock need not be included on the door may and may be positioned elsewhere to secure the door when in the closed position.) Like the shutter lock 36, the door lock 34 may be an electronically operable lock operable between a locked state and an unlocked state in response to messages and/or electronic signal. The door lock 34 is shown to include two bars that extend into a wall of the housing 28 when in the locked state to lock the door 24 in the closed position and that retract when in the unlocked state to permit opening of the door 24. The door lock 34 may be separately controllable from the shutter lock 44 such that individuals having capabilities may to open the shutter 22 may not necessarily have capabilities to open the door 24. A human-machine interface (HMI), touch-screen, display or other interface 40 (see FIG. 1) may be included to facilitate electronically controlling various operations of the safe, including but not limited to the shutter lock 36 and/or the door lock 34, such as through user inputs thereto. A card reader 42 may also be included to read a secure card or magnetic strip configured to facilitate input of a code or other identifier needed to control one or both of the locks. The HMI 40 and/or card reader 42 may be housed below a top side of the housing 28 within a cavity 44. A pull-out tray 46 may be extended to position the HMI 40 and/or card reader 42 outboard of the housing 28.

The HMI 40 may include a network interface (not shown) sufficient to facilitate remote control and networking of the apparatus 10 and the housing 28 may be enclosed in a sleeve (not shown), such as in the manner described in U.S. patent application Ser. No. 13/648,503, the disclosure of which is hereby incorporated by reference in its entirety, and the applications and patents noted above. A switch 48 may be included to facilitate electronically controlling the shutter lock 44. The switch 48 may be a magnetic switch operable to indicate whether the shutter 22 is in one of the closed position and the opened position depending on whether a first magnet mounted to the shutter 22 is aligned with a second magnet mounted to the door 24. The magnetic switch 48 may be configured to facilitate closing a circuit to indicate the shutter 22 being in the opened position when the first magnet aligns with the second magnet and to facilitate breaking the circuit to indicate the shutter 22 being in the closed position when the first magnet is misaligned with the second magnet. While not shown, wires may extend from the shutter lock 36, the door lock 34 and/or the switch 48 to facilitate electronic communications therewith and/or these components may include wireless communication capabilities. A printer 50, such as but not necessarily limited to a thermal printer, may be configured, such as with a printing element and a paper feed system, to facilitate printing receipts 52. The printer 50 is shown to be on the face the pullout tray but may be positioned elsewhere, such as on a top of the tray next to the HMI 40 in order to provide a closer proximately and ease of use when interacting therewith.

Figure 3:
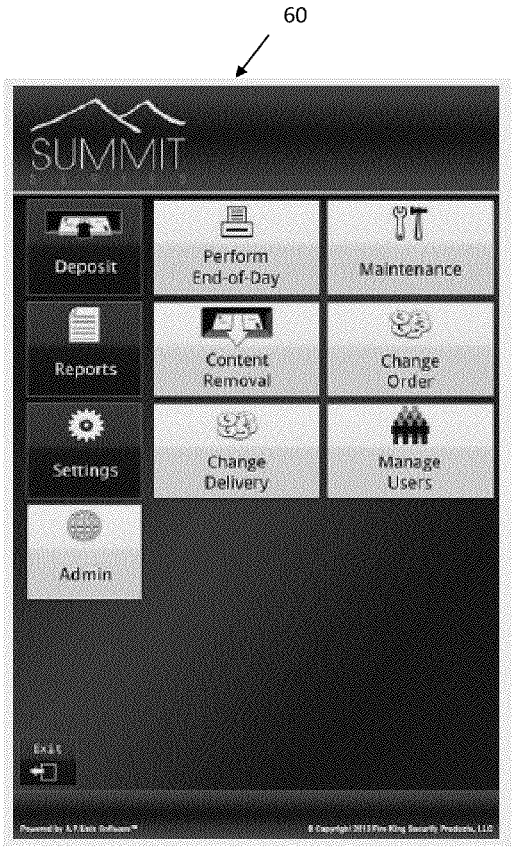
FIG. 3 illustrates an HMI displaying a home screen within a graphical user interface (GUI) in accordance with one non-limiting aspect of the present invention.

FIG. 3 illustrates the HMI displaying a home screen 60 within a graphical user interface (GUI) in accordance with one non-limiting aspect of the present invention. The home screen 60 may be a default menu or other interface displayed to facilitate user interactions with the safe. The home screen is shown to be displayed within the HMI in order to enable a user proximate to the safe to control safe operations. The home screen may be replicated and/or accessed remotely, such as through a web portal/page having capabilities sufficient to implement remote control or network-based manipulation of the safe. While not shown, a log-in screen, keypad or other security measure may be displayed prior to displaying the home screen 60 in order to authenticate a user, e.g., as a function of credentials, a key card, combination input, fingerprint, etc. a plurality of user selectable. The home screen 60 is shown to include a plurality of user selectable icons associated with various operating capabilities of the safe. The icons are shown to include a deposit icon, a reports icon, a settings icon, an admin icon, a perform end-of-day icon, a content removal icon (e.g., door control icon), a change delivery icon, a maintenance icon, a change order icon, a manage users icon and an exit icon.

The home screen icons may be selected by the user to facilitate controlling, manipulating, engaging or otherwise instigating corresponding safe operations. The deposit icon may be selected to facilitate depositing items within the safe, such as by preparing the bill validator to deposit bank notes, preparing a coin deposit (not shown) to accept coins, to open the safe door for depositing larger items and/or to facilitate depositing other items. The reports icon may be selected to facilitate generating reports, such as publishing reports over the network interface, directing the printer to print a particular report, etc. The settings icon may be selected to access various settings of the safe. The admin icon may be selected to access administrative settings of the safe. The perform end-of-day icon may be selected to publish/print daily reports. The content removal icon may be selected to facilitate removing items from the safe, such as by unlocking the door, controlling the validator or other electro-mechanical element to eject contents. The change delivery icon may be selected to change a delivery schedule or time when security personal retrieve safe contents for transport and/or perform another operation. The maintenance icon may be selected to perform maintenance related operations, such as facilitating repair of the bill validator. The change order icon may be selected to change an order. The manage user icon may be selected to facilitate management related controls.

Figure 4:
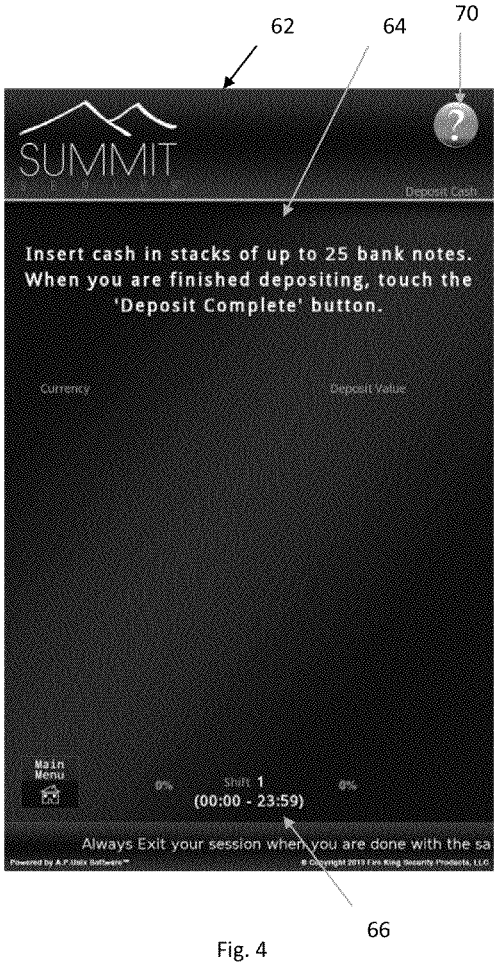
FIG. 4 illustrates the HMI displaying a deposit screen within the GUI in accordance with one non-limiting aspect of the present invention.

FIG. 4 illustrates the HMI displaying a deposit screen 62 within the GUI in accordance with one non-limiting aspect of the present invention. The deposit screen 62 is shown to include a plurality of deposit instructions 64 associated with depositing items within the safe, such as but not limited to the depositing bank notes using the bill validator. The deposit instructions 64 are shown to convey a size limit of the bank notes that may be deposited at one time and activities of the user to be implemented following a corresponding deposit. The deposit screen 62 may be representative of other screens that would appear following selection of the other icons illustrated in the home screen, i.e., selection of the other icons may result in display of additional screens having instructions associated with operations of the other icons shown it the home screen 60. Of course, the present invention is not necessarily limited to the additional screens displaying corresponding instructions and instead may display other screens, interfaces, menus, buttons, etc. to facilitate implementing virtually any number of other controls and/or operations. The deposit screen 62 is also shown to include deposit information 66 regarding deposits previously made, a time associated with a current deposit, a percentage of room left within the safe for additional deposits, etc. a home icon or main menu icon may be included and selected to return the GUI to the home screen, a main menu (not shown) or other screen.

The deposit screen 62 may include a help icon 70. The help icon 70 may be selected for providing the user with help instructions and/or other information sufficient to provide assistance to users when attempting to engage the safe to perform the deposit operations instigated with selection of the deposit icon. One non-limiting aspect of the present invention contemplates providing the help icon 70 within one or more of the screens accessible following selection of one of the icons illustrated within the home screen 60. This use of the help icon 70 may be beneficial in providing additional instructions to the user in order to facilitate controlling safe operations, particularly when such a user may experience difficulties in performing, controlling or otherwise manipulating the electronically controllable operations. While the present invention is predominant described with respect to electronically controlling operations of the safe, as noted above, the present invention is not necessary so limited and fully contemplates its use and application in facilitating safe-keeping of items stored within devices other than a safe. The help icon 70 may be included within screens, menus or other interfaces used with such other devices in order to facilitate providing information sufficient to assist a user when attempting to engage operations particular to such other devices.

Figure 5:
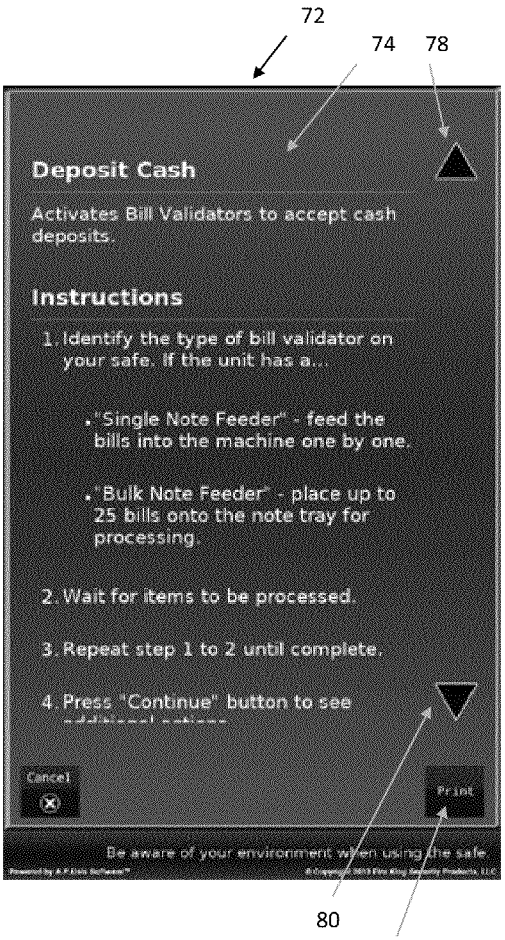
FIG. 5 illustrates the HMI displaying a help screen within the GUI in accordance with one non-limiting aspect of the present invention.

FIG. 5 illustrates the HMI displaying a help screen 72 within the GUI in accordance with one non-limiting aspect of the present invention. The help screen 72 is shown to correspond with information displayed following selection of the help icon 70 within the deposit screen. The help screen 72 is shown to include help instructions 74 associated with assisting the user in performing operations related to undertaking the deposit operation. Other help instructions may be similarly displayed for the other safe operations and/or screens displayed for the other icons illustrated in the home screen following selection of the corresponding help icon. The help screen 72 may include a cancel icon for exiting the help screen 72, such as by returning to the previous screen, i.e., the deposit screen 62, and/or returning to the home screen 60 or other pre-set screen/menu. The help screen 72 may include an up icon 78 and a down icon 80 or other navigational icon/feature to facilitate scrolling through the help instructions. As shown, only a portion of the help instructions 74 initially displayed within the HMI such that a remainder of the help instructions requires the user to engage one of the navigational icons 78, 80. The partial display of the help instructions 74 may result from on a length of the help instructions, a text size, etc., exceeding a display size of the HMI.

Figure 6:
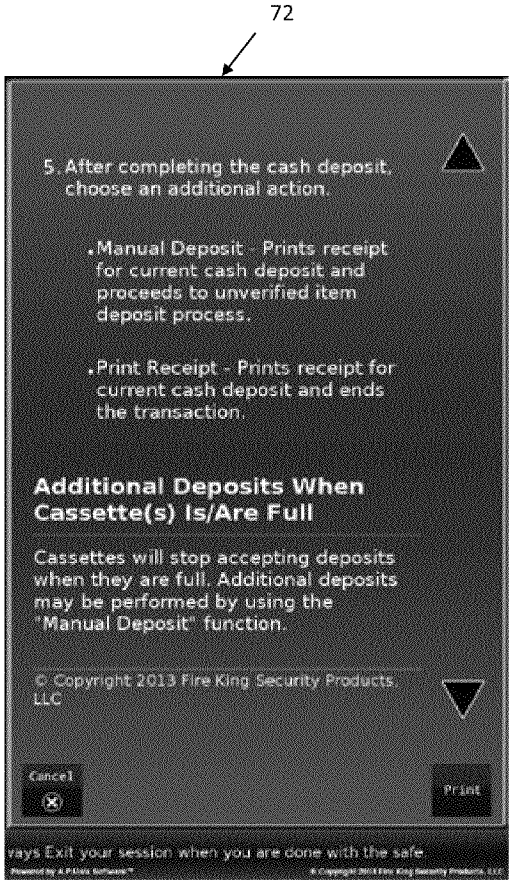

FIGS. 6-7 illustrate the GUI scrolling through the help instructions 74 in accordance with one non-limiting aspect the present invention. FIG. 6 illustrates an additional portion of the help instructions 74 following user selection of the down icon 80 from the help screen 72 of FIG. 5, i.e., a portion of the help instructions not initially displayed. FIG. 7 illustrates yet an additional portion of help instructions 74 following user selection of the down icon 80 from the help screen 72 shown within FIG. 6. The user may at any time actuate the up icon 78 in order to return to one of the previously displayed portions of the help instructions 74, thereby enabling the user to navigate the help instructions 74 to find instructions relevant to a particular sequence in the operation and/or to review complex or easily misunderstood aspects of performing the desired safe operation. As evidenced by the need to facilitate scrolling through or displaying additional portions of the help instructions 74, the user may be required to take notes or remember long passages of instructions in order to perform the desired operation. This can be problematic, particularly when the help instructions 74 direct the user to select particular menus, buttons, etc. within more than one screen associated performing the desired operations, i.e., the user may be required to perform a sequence of inputs and/or to navigate across/through multiple screens, displays, menus, etc.

FIG. 8 illustrates a help receipt 84 that may be used in accordance with non-limiting aspect of the present invention to assist the user in performing the operation associated with the help instructions 74. The help screens 72 (e.g., FIGS. 5-7) may include a user selectable print icon 86, menu, button or other feature sufficient to facilitate generating the help receipt 84. The print icon 86 may be selected from within one of the help screens 72 to facilitate printing all or a portion of the associated help instructions 74. In this manner, the user may easily facilitate printing the help instructions from various help screens 72 without having to navigate away from the help instructions intended 74 to be printed. The print icon 86 may direct the printer 50, a processor (not shown), a controller (not shown) or other feature of the safe 10 to facilitate printing the help receipt 84. The help receipt 84 may include a replication or copy of the help instructions of the screen from which it was selected, optionally all of the help instructions 74, including the portion of the help instructions not initially displayed with the help screen, may be replicated within the help receipt. The illustrated help receipt 84 is shown to be slightly narrower than the help screen 72, such as but not limited to be less than three inches wide, and to including formatting mirroring that shown for the corresponding help instructions 74. Optionally, the help receipt 84 may include a resolution (dots per inch (dpi)) less than that of the help screen 72 depending on the printing capabilities of the printer 50.

Figure 9:
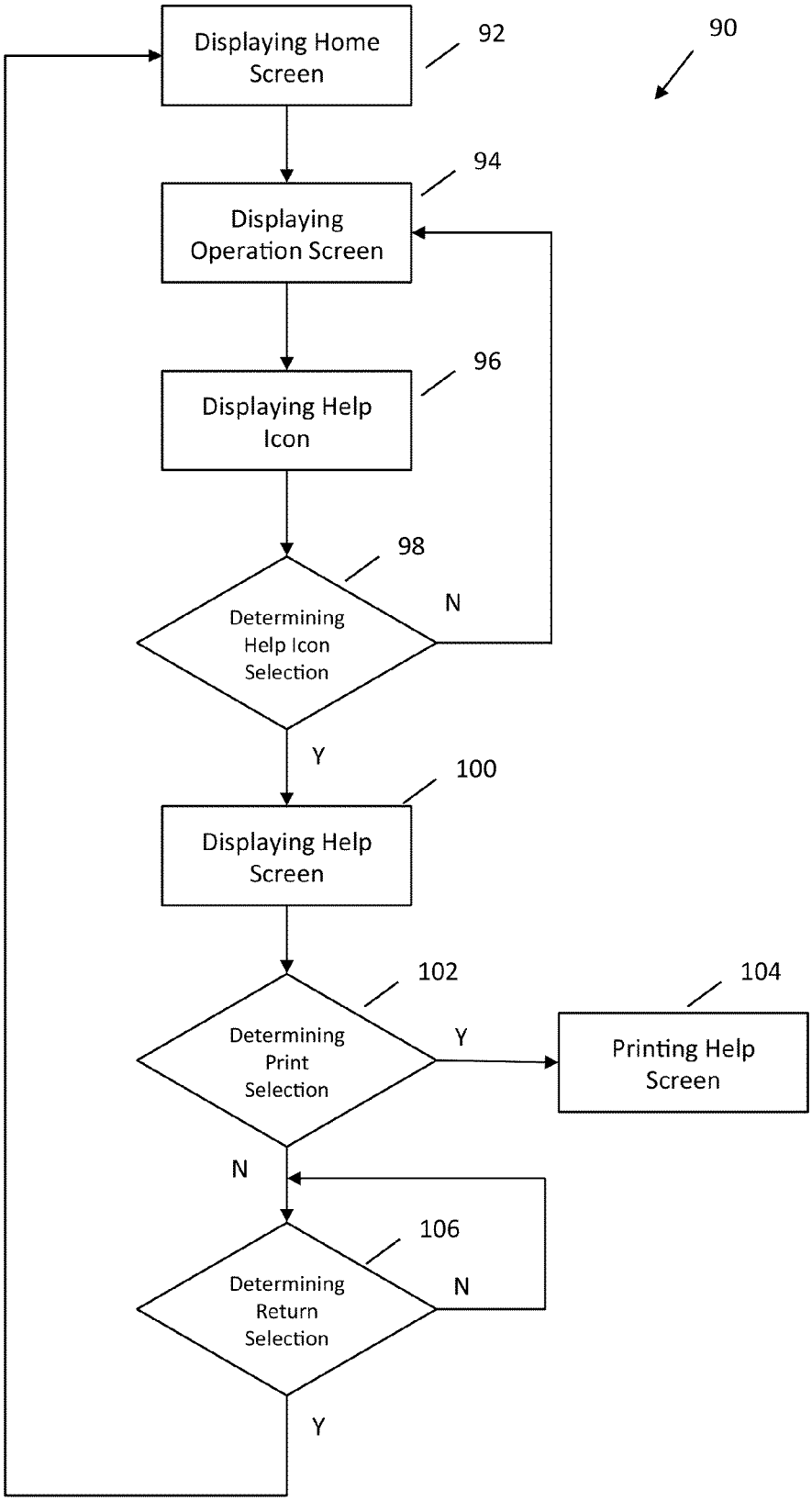
FIG. 9 illustrates a flowchart for a method of controlling a secure storage apparatus in accordance with one non-limiting aspect of the present invention.

FIG. 9 illustrates a flowchart 90 for a method of controlling a secure storage apparatus in accordance with one non-limiting aspect of the present invention. The secure storage apparatus is described for exemplary non-limiting purposes with respect to being a safe similar to the safe described above and applies equally to any type of secure storage system, including vending machines and video gaming machines. The method may be embodied completely and/or partially within a computer-readable medium having non-transitory instructions, operable with the processor of the safe or other device configured to facilitate control and operation thereof, to facilitate the processes contemplated herein. The method contemplates facilitating user control of the safe by providing a means for assisting users in navigating interfaces, menus, screens, displays, GUIs, etc. used to facilitate receiving user input associated with implementing related controls. The means for may comprise one or more of an algorithm, a processor, a computer program product, an application, a software construct, an application program interface (API), a messaging scheme/protocol, a network or remote control feature and/or other devices and logically executing elements having capabilities sufficient to facilitate controlling the safe and/or facilitating communications with a user attempting to control the safe.

Block 92 relates to displaying a home screen or other main menu within an HMI or other user interface associated with the safe. The home screen may be displayed in the manner described above with respect to the GUI or through a mobile phone, a webpage or other interface sufficient to facilitate interfacing user inputs with the safe. The home screen may include a plurality of icons, menus or other feature sufficient to facilitate providing an initial starting point for the user to begin navigating to controllable features of the safe. Blocks 94, 96 relate to displaying an operational screen (e.g., deposit screen) and a help icon within the corresponding operational screen. The operational screen may be associated with describing operations or providing other information regarding one or more option selected from the home screen, e.g., a first operational screen may be displayed in response to selection of a first icon within the home screen and a second, different operational screen may be displayed in response to selection of a second icon within the home screen. One non-limiting aspect of the present invention contemplates assisting a user in performing the operations displayed within the operational screen(s) by providing a help icon therein. While the help icon is shown above to be omitted from the home screen since it may be unlikely for the user to require assistance, particularly assistance directed towards controlling operations of the safe, for the home screen, the present invention is not necessarily so limited and fully contemplates displaying a help icon within the home screen and providing the assistance described herein with respect to such a help icon.

Blocks 98, 100 relate to determining user selection of the help icon and corresponding display of a related help screen. The help screen may display help instructions related to the operational screen displayed during selection of the corresponding help icon. The help instructions, thereby, may be varied depending on the screen preceding this display. Depending on a length of the help instructions, the help screen may be displayed with one or more navigational features sufficient to enable the user to navigate/scroll through the instructions. Blocks 102, 104 relate to determining whether a print icon displayed within the help screen is selected and correspondingly printing a help receipt. Selection of the print icon may direct the printer to print a copy of the help instructions associated with the help screen from watched the print icon was selected. The help receipt may be beneficial in providing a shortened summary (may be a pre-defined portion of the help instructions or shortened summary not previously displayed, e.g., title headings appear in line with reference numerals associated with the steps described in the help instructions—omitting the more detail descriptions of the steps appearing below) and/or an entire recitation of the help instructions that may be of assistance to the user navigating the various screens and/or menus associated with implementing the corresponding operational control of the safe.

Following printing of the help receipt, the home screen may be automatically displayed and/or the preceding screen may be automatically re-displayed. Block 106 relates to the preceding help screen being automatically re-displayed, and thereafter, assessing whether the user has requested to return to the home screen or to continue viewing the help screen. In the event the help receipt is a summary of the help instructions, it may be beneficial to automatically return to the help screen in order to provide the more detailed help instructions shown therein. In the event to help receipt is a complete copy of help instructions, it may be beneficial to automatically return to the home screen, i.e., bypassing the need for the user to engage a return icon, a cancel icon, a main menu icon or other feature within the help screen in order to return to the home screen. Optionally, selection of the print icon may instigate a number of automated operations, such as automatically returning to the home screen and/or printing of the receipt, e.g., enabling printing without requiring the user to navigate away from the help screen or manipulate a print menu (instant printing). In addition to displaying the help instructions within the help screen, one non-limiting aspect of the present invention contemplates enabling printing of the help receipt in order to provide further user assistance.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A safe comprising:

a door operable between an opened position and a closed position, the door preventing access to an internal storage area when in the closed position and the door permitting access to the internal storage area when in the opened position;

a lock electronically operable between a locked and an unlocked position, the lock preventing movement of the door from the closed position to the opened position when in the locked position and the lock permitting movement of the door from the closed position to the opened position when in the unlocked position;

a printer operable to facilitate printing receipts;

a human-machine-interface (HMI) operable to facilitate displaying a graphical user interface (GUI), the GUI operable to facilitate displaying one or more of a plurality of user selectable icons, at least a portion of the plurality of icons enabling a user to facilitate controlling one or more safe operating capabilities in response to corresponding user inputs thereto, the plurality of icons including:

i) a door control icon for operating the lock between the locked and the unlocked positions;

ii) a help icon operable for displaying help instructions within the HMI sufficient to visually assist a user with respect to one or more of the safe operating capabilities;

iii) a print icon operable for controlling the printer to print a help receipt, the help receipt replicating the help instructions;

a bill validator operable to deliver bank notes to the internal storage area when the door is in the closed position;

wherein the plurality of icons includes a deposit icon, user selection of the deposit icon controlling the bill validator to prepare for receipt and delivery of one or more bank notes to the internal storage area and for controlling the GUI to display a deposit screen having deposit instructions associated with depositing the one or more bank notes within the internal storage area;

wherein the help icon appears within the deposit screen, whereupon selection of the help icon causes the GUI to remove the deposit screen and instead display a help screen, the help screen displaying the help instructions such that the help instructions visually instruct the user with regard to depositing the one or more bank notes;

wherein the print icon appears within the help screen, whereupon selection of the print icon causes the printer to print the help receipt;

wherein the help instructions require the user to select a plurality of buttons from within the deposit screen in a pre-defined order of steps in order to successfully deposit the one or more bank notes; and wherein the deposit screen associated with a first one of the pre-defined order of steps is automatically displayed following selection of the print icon from within the help screen.

2. The safe of claim 1 wherein the helps screen includes an up icon and a down icon, the up and down icons being sufficient for scrolling through the help instructions, including scrolling through the help instruction to display at least a portion of the help instructions not initially displayed within the help screen.

3. The safe of claim 2 wherein the printer is directed to print an entirety of the help instructions on the help receipt in response to selection of the print icon, including the portion of the help instructions not initially displayed within the help screen.

4. The safe of claim 3 wherein the printer is directed to print the help receipt without the GUI displaying a print screen following user selection of the print icon from within the help screen.

5. The safe of claim 1 wherein the GUI is configured to remove the help screen immediately following user selection of the print icon from within the help screen, whereupon the deposit screen is immediately re-displayed through the HMI.

6. The safe of claim 1 wherein the GUI is configured to remove the help screen immediately following user selection of the print icon from within the help screen.

7. The safe of claim 1 wherein the GUI is configured to:

display a print screen following selection of the print icon from within the help screen and prior to printing the help receipt, the print screen requiring the user to input a print confirmation before printing the help receipt; and automatically bypass the help screen and return to the deposit screen upon receiving the print confirmation, thereby enabling the user to immediately begin depositing the one or more bank notes without having to close the help screen.

8. The safe of claim 1 whereupon selection of the print icon automatically returns the GUI to the deposit screen without requiring the user to engage a return icon, a cancel icon, a main icon or other feature within the help screen, thereby enabling the user to immediately begin depositing the one or more bank notes without having to close the help screen.

9. The safe of claim 2 wherein the printer prints the help receipt to include only the portions of the help instructions previously displayed using the up or down icons, thereby limiting the help receipt to include only portions of the help instructions the user recently navigated to using the up and down icons.

10. A safe comprising:

a door operable between an opened position and a closed position, the door preventing access to an internal storage area when in the closed position and the door permitting access to the internal storage area when in the opened position;

a lock electronically operable between a locked and an unlocked position, the lock preventing movement of the door from the closed position to the opened position when in the locked position and the lock permitting movement of the door from the closed position to the opened position when in the unlocked position;

a bill validator operable to deliver bank notes to the internal storage area when the door is in the closed position;

a printer operable to facilitate printing receipts;

a human-machine-interface (HMI) operable to facilitate displaying a graphical user interface (GUI), the GUI operable to facilitate displaying a home screen having a plurality of user selectable icons, one of the plurality of user selectable icons being a deposit icon, selection of the deposit icon directing:

i) the bill validator to prepare for depositing one or more bank notes to the internal storage area, and ii) the GUI to display a deposit screen having deposit instructions associated with depositing the one or more bank notes;

wherein the deposit screen includes a user selectable help icon, selection of the help icon directing the GUI to display a help screen having help instructions sufficient for instructing the user with regard to depositing the one or more bank notes;

wherein the help screen includes a user selectable print icon, selection of the print icon directing the printer to print a help receipt, the help receipt printing a copy of the help instructions;

wherein the help instructions require the user to select a plurality of buttons from within the deposit screen and at least one additional screen in a pre-defined order of steps in order to successfully deposit the one or more bank notes; and wherein the at least one additional screen associated with a first one of the pre-defined order of steps is automatically displayed following selection of the print icon from within the help screen.

11. The safe of claim 10 wherein the help screen includes at least one user selectable navigation icon, selection of one of the at least one navigation icon directing the GUI to display at least a portion of the help instructions not initially displayed within the help screen.

12. The safe of claim 11 wherein the printer is directed to include all of the help instructions within the help receipt, including the portion of the help instructions not initially displayed within the help screen such that each of the sequence of steps are represented within the help receipt, thereby enabling the user to deposit the one or more bank notes by following the printed help instructions and without having to take notes or remember long passages of the help instructions.

13. The safe of claim 10 wherein:

the printer automatically prints the help receipt without displaying a print screen following user selection of the print icon from within the help screen.

14. The safe of claim 10 wherein the GUI automatically displays the deposit screen following selection of the print icon so as to return the user thereto without having to engage a return icon, a cancel icon, a main icon or other feature within the help screen.

15. A computer-readable medium having non-transitory instructions, operable with a processor, to facilitate controlling operations of a safe having a touch-screen and a printer, the touch-screen being operable to relay user inputs associated with controlling operations of the safe, the printer being operable to print receipts, the non-transitory instructions being sufficient for:

displaying a home screen having a plurality of user selectable icons selectable to facilitate electronically controlling operations of the safe, a first icon of the plurality of user selectable icons being selectable to control a first operation of the safe, a second icon of the plurality of user selectable icons being selectable to control a second operation of the safe;

displaying a first screen in response to user selection of the first icon, the first screen displaying first instructions associated with the first operation;

displaying a second screen in response to user selection of the second icon, the second screen having second instructions associated with the second operation;

displaying a help icon within each of the first screen and the second screen, including displaying a first help screen following selection of the help icon from the first screen and displaying a second help screen following selection of the help icon from the second screen, the first help screen displaying first instructions associated with the first operation and the second help screen displaying second instructions associated with the second operation;

displaying a print icon within each of the first help screen and the second help screen;

directing the printer to print a first receipt follow selection of the print icon from the first help screen and to print a second receipt following selection of the print icon from the second help screen, the first receipt including a copy of the first instructions and the second receipt including a copy of the second instructions;

wherein the first instructions require the user to select a first plurality of buttons from within the first screen and at least one first additional screen in a first pre-defined order of steps;

wherein the second instructions require the user to select a second plurality of buttons from within the second screen and at least one second additional screen in a second pre-defined order of steps;

wherein the at least one first additional screen associated with a first one of the first pre-defined order of steps is automatically displayed following selection of the print icon from within the first help screen; and wherein the at least one second additional screen associated with a first one of the second pre-defined order of steps is automatically displayed following selection of the print icon from within the second help screen.

16. The computer-readable medium of claim 15 further comprising non-transitory instructions sufficient for displaying at least one user selectable navigation icon within the first help screen, including displaying at least a portion of the help instructions not initially displayed within the first help screen following selection of the at least one user selectable navigation icon.

17. The computer-readable medium of claim 16 further comprising non-transitory instructions sufficient for directing the printer to print all of the first instructions within the first receipt, including the portion of the first instructions not initially displayed within the first help screen.

18. The computer-readable medium of claim 15 further comprising non-transitory instructions sufficient for automatically returning to one of the first and second additional screens following selection of the print icon so as to return the user thereto without having to engage another icon within the help screen following selection of the print icon.

* * * * *